US008876480B2

(12) United States Patent
Witt

(10) Patent No.: US 8,876,480 B2
(45) Date of Patent: Nov. 4, 2014

(54) REINFORCING ELEMENT FOR USE WITH A VENTILATOR HUB

(76) Inventor: Henrik Witt, Hamburg (DE)

( * ) Notice: Subject to any disclaimer, the term of this patent is extended or adjusted under 35 U.S.C. 154(b) by 508 days.

(21) Appl. No.: 13/256,826

(22) PCT Filed: Apr. 11, 2010

(86) PCT No.: PCT/EP2010/002222
§ 371 (c)(1),
(2), (4) Date: Sep. 27, 2011

(87) PCT Pub. No.: WO2010/115637
PCT Pub. Date: Oct. 14, 2010

(65) Prior Publication Data

US 2012/0034099 A1 Feb. 9, 2012

(30) Foreign Application Priority Data

Apr. 11, 2009 (DE) ..... 10 2009 017 307

(51) Int. Cl.

| | |
|---|---|
| ***F01D 5/02*** | (2006.01) |
| ***B23P 15/00*** | (2006.01) |
| ***F04D 29/32*** | (2006.01) |
| ***F04D 29/02*** | (2006.01) |

(52) U.S. Cl.
CPC ..... *F04D 29/329* (2013.01); *F04D 29/023* (2013.01)
USPC ..... 416/204 R; 416/208; 416/210 R; 416/213 R; 416/220 R; 416/241 R

(58) Field of Classification Search
USPC ..... 416/204 R, 207, 208, 210 R, 213 R, 416/219 R, 220 R, 241 R
See application file for complete search history.

(56) References Cited

U.S. PATENT DOCUMENTS

| | | | | |
|---|---|---|---|---|
| 2,541,098 | A * | 2/1951 | Redding | 416/193 R |
| 4,863,352 | A * | 9/1989 | Hauser et al. | 416/204 R |
| 5,112,191 | A * | 5/1992 | Strock et al. | 416/94 |
| 8,622,699 | B2 * | 1/2014 | Gallet et al. | 416/2 |

* cited by examiner

*Primary Examiner* — Igor Kershteyn
(74) *Attorney, Agent, or Firm* — North Weber & Baugh LLP

(57) ABSTRACT

In order to provide a ventilator hub having coupling elements for connecting to a ventilator spindle and an essentially cylindrical fastening section having radial adapters for a number of ventilator blades, whereby the fastening section has an inner casing surface that ensures fastening of the ventilator blades with sufficient tensile strength, even at high temperatures, such as they can occur in tunnel fires, without thereby having an undesirably high mass, it is proposed to provide the ventilator hub with an essentially annular, closed reinforcement element having coupling elements for fastening the ventilator blades with high tensile strength, that is designed essentially separate from the fastening section.

8 Claims, 4 Drawing Sheets

REINFORCING ELEMENT FOR USE WITH A VENTILATOR HUB

CROSS REFERENCE TO RELATED APPLICATIONS

This application is the National Phase Application under 35 USC §371 of International Application No. PCT/EP2010/002222, filed Apr. 9, 2010, which claims priority to German Patent Application 10 2009 017 307.2, filed Apr. 11, 2009, all of which are herein incorporated by reference.

BACKGROUND

A. Technical Field

The present invention relates to a ventilator hub, with means for connecting a ventilator spindle and a substantially cylindrical fastening section with radial adapters for a number of ventilator blades, whereby the fastening section has an inner casing surface.

The invention likewise relates to a reinforcement element for use with a ventilator hub having means for fastening a number of ventilator blades with high tensile strength.

Finally, the invention relates to a method for the production of a ventilator with a ventilator hub.

B. Background of the Invention

Ventilators for underground railways or tunnels and/or closed vehicle buildings such as, for example, underground garages, must work very reliably for very long useful lives at various load conditions and environmental conditions. The installation of ventilators in underground railroads or tunnels or underground garages is typically configured for an operating life of several years or decades. In particular, when ventilators are used as smoke removing ventilators in subways or tunnels by metro or tunnel operators, demands are made on the operability of the ventilator at high temperatures, as they occur, in particular, in cases of fire. Some of the demands are specified by law.

On the other hand, as is generally customary, there is a desire to produce ventilators as cost-effective and material-saving as possible. In general, the basic structure of a ventilator consists of a ventilator hub, to which a number of ventilator blades are attached radially. The ventilator blades are fastened by using fastening means such as, for example, pins.

Given the background of the general demands made on ventilators described above, various ventilator blades are known. To keep the mass low, ventilator hubs are known that consist of solid aluminum or an aluminum alloy. However, their limited usability at temperatures above 300° C., makes ventilator hubs made of aluminum disadvantageous. Because the tensile strength of aluminum decreases substantially at the cited temperatures, so that the aluminum slowly begins to flow. Even specialized aluminum alloys are not able to significantly improve this shortcoming. As a consequence of this disadvantageous property of aluminum, ventilator blades can detach from a ventilator hub made of aluminum at high temperatures such can as they occur, for example, in fires.

Because of this shortcoming of ventilator hubs made of aluminum, high volume smoke removing ventilators, i.e. at high speed and/or with large blade lengths of related art use ventilator hubs made of solid steel. But, ventilator hubs made of steel have the disadvantage of having a very large mass.

SUMMARY OF THE INVENTION

It is therefore the objective of the present invention to provide a ventilator hub of the type cited at the beginning that ensures a fastening of ventilator blades with sufficient tensile strength even at high temperatures such as they can occur in the case of tunnel fires, without thereby having an undesirably large mass.

The invention is likewise based on the objective to provide a reinforcement element for use with a ventilator hub of the type cited at the beginning, with the help of which the disadvantages of prior art that were mentioned can be avoided.

Finally, the present invention is based on the objective to provide a method for producing a ventilator with a ventilator hub.

According to the invention, this type of problem of the ventilator hub described at the beginning is solved thereby, that a substantially annular, closed reinforcement element with means for fastening the ventilator blades with high tensile strength is provided that is essentially separate from the fastening section. Thus, it is provided within the scope of the invention, to add a reinforcement element to the ventilator hub in the form of an additional component.

Thereby that according to the invention, the reinforcement element is substantially annular, the reinforcement element can absorb radial forces and keep them completely away from the axial fan wheel hub that is made of aluminum, for example. In the case of balanced ventilators, the reinforcement element does not exert any force on the ventilator hub.

The tensile strength of the unit that is subject to heat, which consists of ventilator hub and reinforcement element, is thereby determined exclusively by the material of the reinforcement element. In this way, an optimized work material can be selected advantageously for the purpose of fastening the ventilator blades at the ventilator with high tensile strength. At the same time, and independent of that, an optimized material can be selected for the actual ventilator hub. In particular, the reinforcement element can be advantageously selected from a material with high tensile strength when subjected to heat and good long-time behavior at high temperatures. According to the invention, at the same time, an especially light material can be selected for the ventilator hub, without thereby influencing the tensile strength of the ventilator overall when it is subjected to heat.

In [an] advantageous design of the invention it is provided that the reinforcement element has at least two segments that can be welded together. The production of a ventilator hub, which is provided with the reinforcement element according to the invention, is particularly simple based on this technique. In particular, it is possible to retrofit an axial fan wheel hub of the conventional type with a reinforcement element according to the invention, in order to improve the tensile strength when subjected to heat.

In [a] further advantageous design of the invention it is provided that the number of segments corresponds to half of the number of ventilator blades that are to be attached. For example, in the case of a four-blade fan wheel, i.e. a fan wheel with a total of four ventilator blades, two segments can be provided. In a six-blade fan wheel, three segments can be provided. In an eight-blade fan wheel, four segments can be provided correspondingly.

The fastening of the reinforcement element according to the invention at a ventilator hub is improved even further if in the design of the invention, the reinforcement element has an at least substantially flat section, the surface normal of which—when used as intended—can be oriented in the radial direction of a ventilator hub.

In [the] preferred design of the reinforcement element according to the invention, the number of the flat sections corresponds to twice the number of the ventilator blades that are to be attached. Thus, according to this design of the invention, in a four-blade fan wheel, eight flat sections are present. Because of the symmetry that is to be generally demanded of rotating structures, a cross section surface of the substantially annular reinforcement element results, that corresponds to an n-corner. In corresponding manner, a six-blade fan wheel would have twelve flat sections, an eight-blade fan wheel sixteen flat sections, and a twelve-blade fan wheel would have twenty four flat sections.

In another advantageous design of the reinforcement element according to the invention, it is essentially made of steel. The tensile strength when subjected to heat and the long-time behavior of steel are excellent, even at temperatures above, for example, 300° C. In particular, the tensile strength when subjected to heat is substantially better at the cited temperatures than that of aluminum.

The problem on which the invention is based is likewise solved by a ventilator hub with means for connection with a ventilator spindle and/or a hub core and an essentially cylindrical fastening section with radial adapters for a number of ventilator blades, whereby the fastening section has an inner casing surface, which is provided with an essentially annular, closed reinforcement element with means for fastening the ventilator blades with high tensile strength that is designed substantially separate from the fastening section. The substantially annular fastening section can advantageously be made of a material with more tensile strength than the ventilator hub otherwise. The fastening section can, for example, have the form of a bent steel brace. In the simplest case, the means for fastening the ventilator blades with tensile strength can be bores with or without a thread.

The ventilator hub according to the invention is improved further when the reinforcement element is located essentially along the inner casing surface of the fastening section. The interior space of the ventilator hub is, as a rule, free of structural parts. Therefore, the reinforcement element according to the invention can be advantageously retrofitted approximately in the form of a bent steel brace, without requiring design adaptations of the fan wheel hub. Moreover, in the event of imbalances of the ventilator, the cylindrical fastening section of the hub can additionally absorb radial forces, if necessary, in order to retain the reinforcement element in position.

A particularly firm retention that is also suitable for absorbing axial forces between the reinforcement element and the ventilator hub results in the refinement of the ventilator hub according to the invention, if the inner casing surface—in a section around a least one radial adapter—has an essentially flat section, the surface normal of which is essentially oriented in the radial direction of the ventilator hub. The flat sections can, for example, be produced by milling.

It is especially favorable, if within the scope of the invention, the ventilator hub is essentially made of aluminum. Aluminum is the preferred material for an axial fan wheel hub, because of weight. According to the invention, a ventilator hub made of aluminum can, in spite of the unfavorable properties of aluminum with respect to tensile strength when subjected to heat, have, in connection with a reinforcement element according to the invention, the required tensile strength when subjected to heat. Because the reinforcement element can, within the scope of the invention, simultaneously be made of steel.

The objective of the method on which the present invention is based is solved by a method for producing a ventilator with a ventilator hub in which a. first, each segment of the reinforcement element of the inner casing surface of the fastening section of the ventilator hub is brought closer in such a way that the means for fastening with high tensile strength with the radial adapters of the cylindrical fastening section, are aligned in radial and axial direction;
b. subsequently, threaded bolts of the ventilator blades that are to be fastened are inserted into the radial adapter of the cylindrical fastening section and into the means for fastening with high tensile strength;
c. subsequently, each segment of the reinforcement element is screwed together with the cylindrical fastening section of the ventilator hub by using the threaded pin of the ventilator blade that is to be fastened respectively;
d. finally, the segments of the reinforcement element that are screwed together with the cylindrical fastening section of the ventilator hub are welded together to form a continuous, substantially annular, closed reinforcement element.

The method according to the invention makes subsequent retrofitting of conventional axial fan wheel hubs made of aluminum, or other hubs for ventilators with a reinforcement element according to the invention possible. As the result of the annular form of the steel element being created only upon welding the individual segments of the reinforcement element after fastening the individual segments to the hub—under certain circumstances—a problematic adaptation of a one-part reinforcement element is avoided, during which, for example, a ventilator hub made of aluminum, could perhaps be damaged by scratches. Moreover, by using the production process according to the invention, an optimal contact of the reinforcements that consists of individual segments with the inner casing surface of the ventilator hub element is achievable.

BRIEF DESCRIPTION OF THE DRAWINGS

The invention is described by way of an example in a preferred embodiment by referring to a drawing, whereby additional advantageous details can be learned from the figures in the drawing.

Functionally equal parts are labeled with the same reference number.

In detail, the figures of the drawing show:

FIG. 1 illustrates an axial fan wheel hub made of aluminum as component of an embodiment of the invention.

Figure 1:
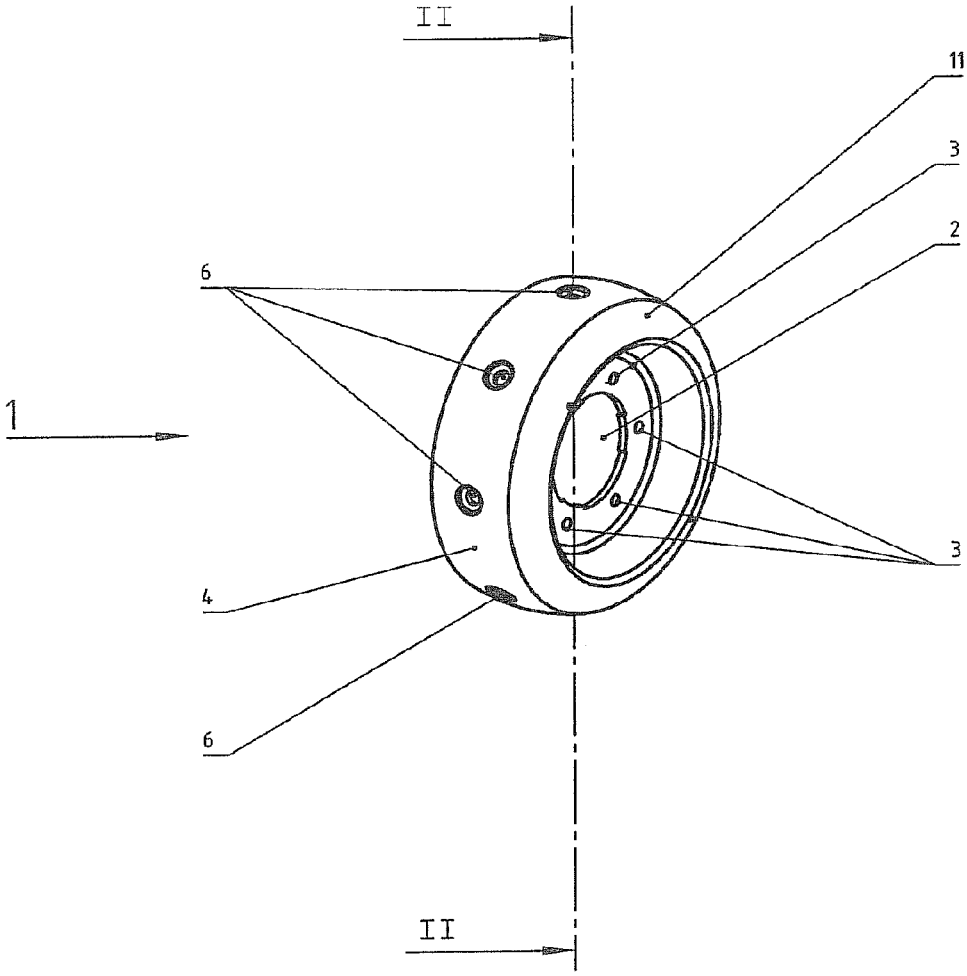
Figure 2:
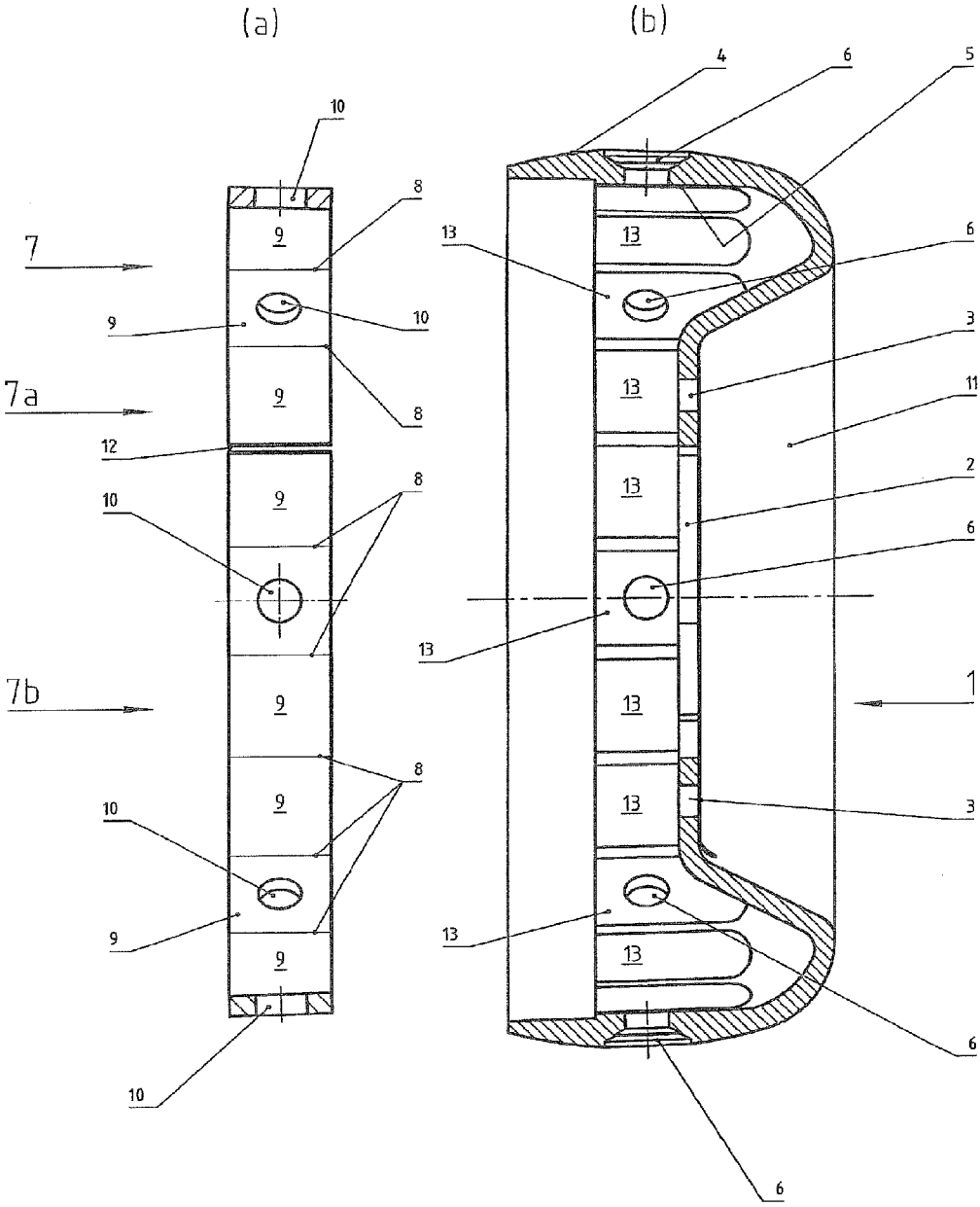
Figure 3:
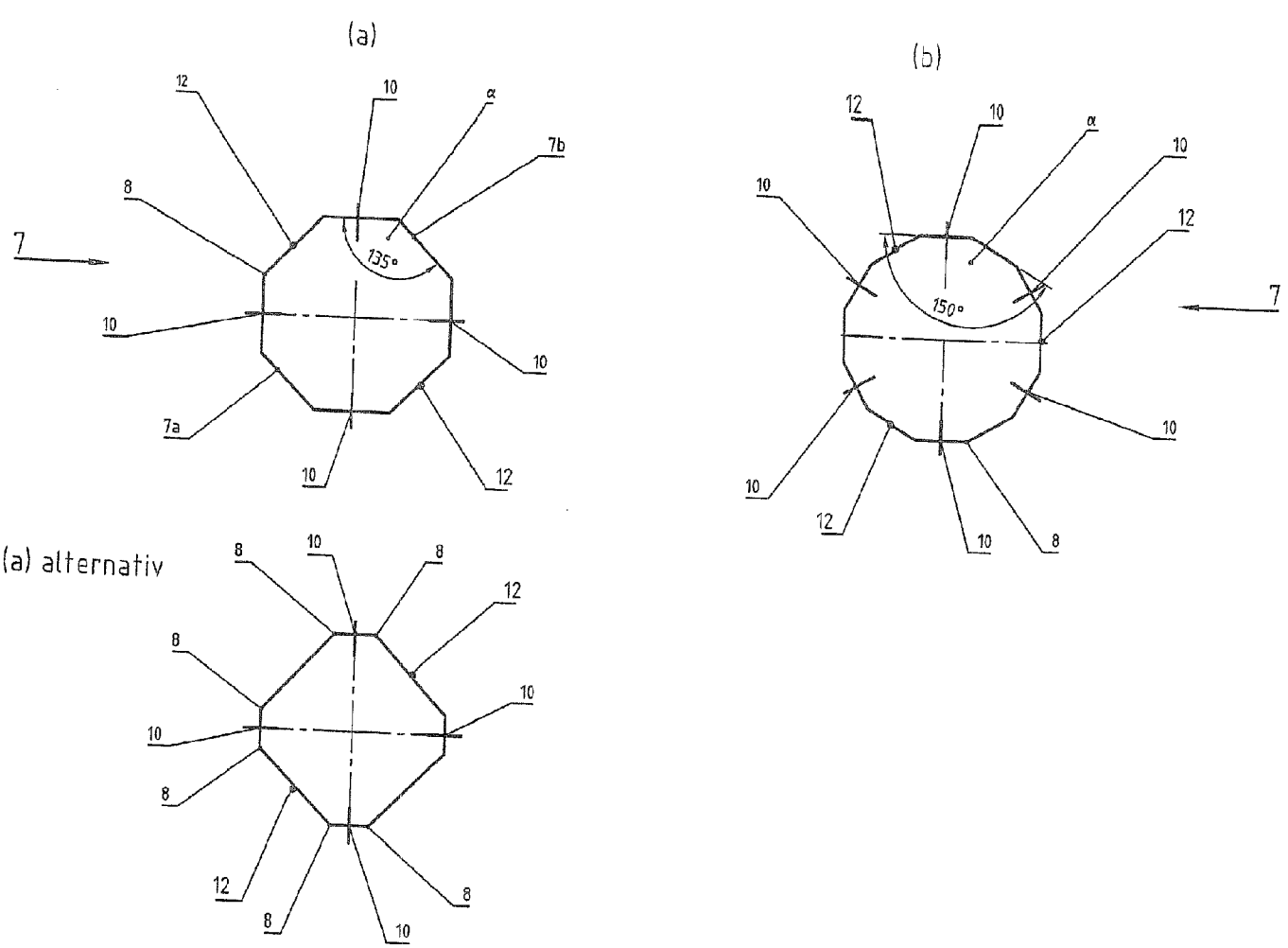
Figure 3:
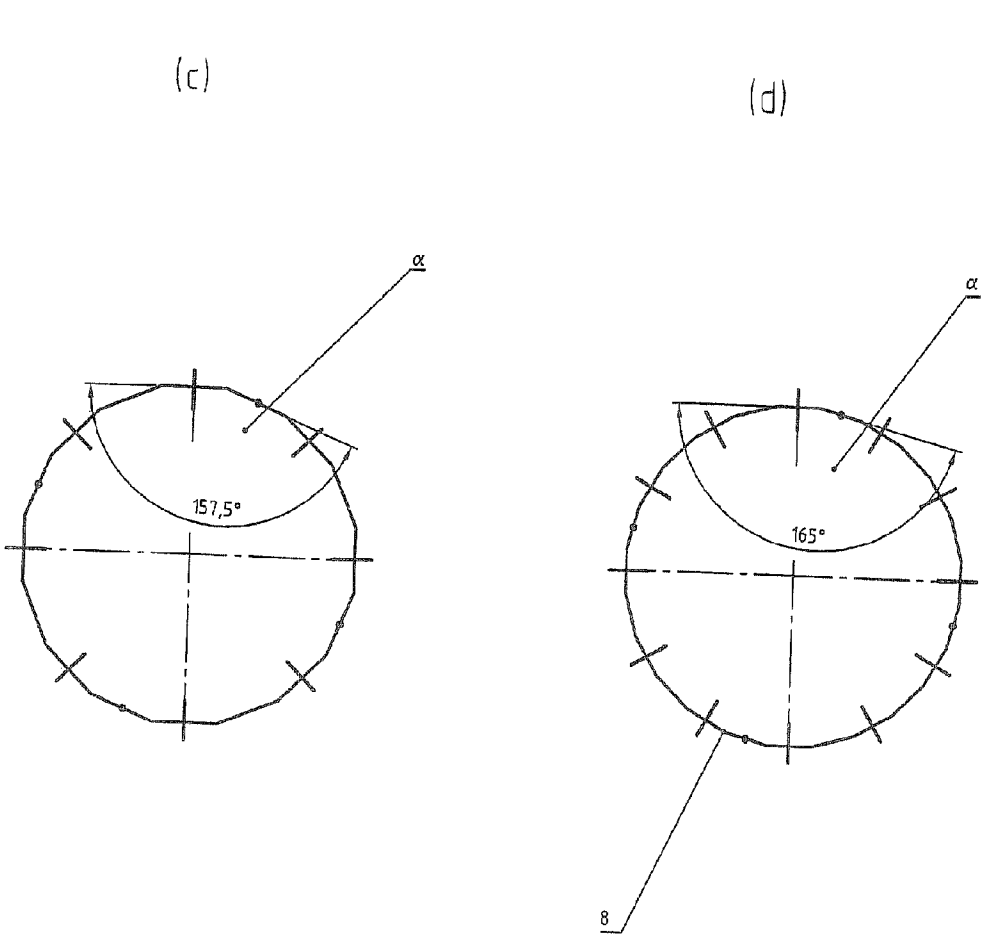

FIGS. 2(*a*) and 2(*b*) illustrate a radial cross section through a steel reinforcement brace according to various embodiments in the invention, and a radial cross section through the axial fan wheel hub according to FIG. 1, to which the reinforcement brace according to the invention according to part (*a*) can be added, whereby the cross section extends along line II-II in FIG. 1;

FIG. 3 illustrates an axial top view onto various designs of the reinforcement element according to the invention as per FIG. 2 (*a*) in schematic illustration.

DETAILED DESCRIPTION OF THE PREFERRED EMBODIMENTS

FIG. 1 shows an axial fan wheel hub 1 in perspective view. Axial fan wheel hub 1 essentially corresponds to a hub according to prior art. It has a central bore 2 for connecting—if necessary by using a hub core that is not shown—with a ventilator spindle that is not shown. Around central bore 2, fastening bores 3 are situated on a circular line for establishing a flange connection with the hub core—not shown—for fastening with a ventilator spindle that is not shown.

Beyond that, axial fan wheel hub 1 has a cylindrical fastening section 4. Fastening section 4 has an inner casing surface 5. In cylindrical fastening section 4, radial adapter bores 6 are present at equal angular distance. In the schematic illustration according to FIG. 1, not all adapter bores 6 that are actually required for load-free operation of a ventilator are shown.

Adapter bores 6 serve to accommodate ventilator blades that are not shown with the aid of blade pins that are attached to the ends of the ventilator blades. In prior art, fastening of the ventilator blades is accomplished by inserting the blade pins into the radial adapter bores 6 in cylindrical fastening section 4 of axial fan wheel hub 1, and subsequently screwing together the ventilator pin having a thread with the aid of a screw nut located at inner casing surface 5. A tapered casing section 11 is attached to cylindrical fastening section 4 having radial adapter bores 6. To the extent axial fan wheel hub 1 is made of aluminum, this arrangement has, however, insufficient tensile strength at temperatures as they can occur in tunnel fires, i.e. at 300° C. to 400° C.

With the help of FIG. 2 it is illustrated how, within the scope of the invention, the problem of insufficient tensile strength when an axial fan wheel hub 1 made of aluminum is subjected to heat, is solved. Part (*a*) of FIG. 2 shows a reinforcement brace 7 according to the invention in a radial cross section corresponding to cross sectional direction II-II from FIG. 1.

At bending lines 8, the reinforcement brace 7 is bent respectively at the same angle α (compare FIG. 3). In the perspective view according to FIG. 2 (*a*), the curve is to be understood as extending from the plane of projection. Between bending lines 8, reinforcement brace 7 respectively extends in the form of a flat, unbent section 9. Unbent sections 9 have, according to this embodiment, respectively the same length and width. Each third flat section 9 has a bore 10. According to a different embodiment of the invention, which is described in the following with the help of FIG. 3 (*a*'), longer sections 9 are located respectively adjacent to shorter sections 9'.

Furthermore, it can also be seen in FIG. (*a*) that reinforcement brace 7 consists of segments 7*a*, 7*b*. Segments 7*a*, 7*b* are connected with each other along welding seam 12. Welding seam 12 is simultaneously a bending line within the meaning of bending lines 8.

In the same cross section perspective as that of part (*a*) of FIG. 2, FIG. 2 (*b*) shows an axial fan wheel hub 1, which is essentially constructed like axial fan wheel hub 1 that is shown in perspective in FIG. 1. In FIG. 2 (*b*), however, the specific design of the inner casing surface 5 can also be seen. In inner casing surface 5, flat surfaces 13 are located aligned in axial direction to each other. Flat surfaces 13 have approximately the same dimensions in a direction that is perpendicular to the axial direction, as the flat sections 9 of reinforcement brace 7.

Various designs of reinforcement brace 7 are shown in an axial lateral view in FIG. 3. Thereby, FIG. 3 (*a*) shows a reinforcement brace 7 for use in an axial fan wheel hub 1 for a four-blade fan wheel, i.e. a fan wheel with a total of four ventilator blades. Reinforcement brace 7 is constructed from two segments 7*a*, 7*b*. Segments 7*a*, 7*b* are connected or can be connected along welding seams 12.

FIG. 3 (*a*') shows an alternative embodiment of the reinforcement brace according to the invention as per FIG. 3 (*a*). Congruent with the reinforcement brace according to FIG. 3 (*a*), the reinforcement brace shown in FIG. 3 (*a*') is provided for use in an axial fan wheel hub 1 for a fan wheel with a total of four ventilator blades. Differing from the embodiment according to FIG. 3 (*a*), unbent sections 9 have, however, pair wise different lengths in radial direction. As can be seen in FIG. 3 (*a*'), adjacent, unbent sections 9 or 9' have different length in radial direction. However, radially diametrically opposed sections 9, 9' respectively have the same radial lengths. In this design, the longer sections 9 do not touch the ventilator hub.

In FIG. 3 (*b*), an embodiment of reinforcement brace 7 according to the invention is shown for a six-blade fan wheel. Reinforcement brace 7 according to FIG. 3 (*b*) consists of three segments, which are or which can be connected with each other at welding seams 12.

FIG. 3 (*c*) shows an embodiment of reinforcement brace 7 according to the invention for an eight-blade fan wheel, which consists of four segments 7*a*, 7*b*, 7*c*, 7*d*. Finally, FIG. 3 *d*) shows an embodiment of reinforcement brace 7 according to the invention that is suitable for a twelve-blade fan wheel, and is likewise constructed from four segments. The structure of the embodiment according to FIGS. 3 (*c*) and (*d*) otherwise corresponds to the embodiments according to FIGS. (*a*) and (*b*).

In order to provide an axial fan wheel hub according to FIG. 1 or FIG. 2 (*b*) with a reinforcement brace 7 according to the invention, first each segment 7*a*, 7*b*, . . . , is screwed in at the inner casing surface 5 of axial fan wheel hub 1. To do so, the blade pin of the ventilator blades that are to be fastened is inserted through the radial adapter bore 6 into cylindrical fastening section 4 of radial fan wheel hub 1, and subsequently inserted through aperture 10 that has been aligned with adapter bore 6, into reinforcement brace 7. Thereby, the flat sections 9 of reinforcement brace 7 engage with the cutouts 13 in inner casing surface 5 of fastening section 4 of hub 1.

The unit consisting of the segment of reinforcement brace 7 and axial fan wheel hub 1 is then screwed together with the help of a counter nut in the customary way. After each of the segments 7*a*, 7*b*, . . . of reinforcement brace 7 has been screwed into inner casing surface 5 of cylindrical fastening section 4 of axial fan wheel hub 1 in the way described, the individual segments 7*a*, 7*b* of reinforcement brace 7 are welded together along welding seams 12 in the interior of axial fan wheel hub 1.

In this way, an axial fan wheel hub 1 according to the invention is obtained, which is for one light in weight, and for another, even at higher temperatures, such as they can occur perhaps in fires in underground railways or tunnels, has sufficient tensile strength. According to the invention, this is achieved by making the reinforcement brace, in particular, out of a construction steel such as, for example, S235JR, and axial hub 1 out of aluminum or an aluminum alloy.

What is claimed is:

1. A ventilator hub comprising:

a first coupling element to couple the ventilator hub to a ventilator spindle or a hub core;

a substantially cylindrical fastening section comprising a plurality of radial adapters to couple a plurality of ventilator blades, the substantially cylindrical fastening section having an inner casing surface; and a reinforcement element that is substantially annular and closed, the reinforcement element comprises a second coupling element to fasten with high tensile strength the plurality of ventilator blades, wherein the reinforcement element is made substantially of steel and separate from the substantially cylindrical fastening section, and wherein the ventilator hub is made substantially of aluminum.

2. The ventilator hub according to claim 1, wherein the reinforcement element is located substantially extending along the inner casing surface of the substantially cylindrical fastening section.

3. The ventilator hub according to claim 2, wherein the inner casing surface comprises a substantially flat section around at least one of the plurality of radial adapters, the substantially flat section is oriented substantially perpendicular to a radial direction of the ventilator hub.

4. The ventilator hub according to claim 1, wherein the reinforcement element comprises at least two segments, wherein the two segments are welded to each other.

5. The ventilator hub according to claim 4, wherein the number of segments is half the number of the plurality of ventilator blades.

6. The ventilator hub according to claim 1, wherein the reinforcement element comprises at least one substantially flat section, and the surface normal of the at least one substantially flat section is designed to be oriented substantially perpendicular to a radial direction of the ventilator hub.

7. The ventilator hub according to claim 6, wherein the number of substantially flat sections is twice the number of the plurality of ventilator blades.

8. A method to produce a ventilator comprising a ventilator hub, the method comprising the steps of:

bringing at least one segment of a reinforcement element close to an inner casing surface of a cylindrical fastening section in the ventilator hub, the reinforcement element comprising coupling elements to fasten with high tensile strength a plurality of ventilator blades, a plurality of radial adapters being included in the cylindrical fastening section and aligned in radial and axial directions of the ventilator hub;

inserting a plurality of threaded pins of the plurality of ventilator blades into the plurality of radial adapters of the cylindrical fastening section and into the coupling elements to enable a high tensile strength connection;

fastening the at least one segment of the reinforcement element to the cylindrical fastening section of the ventilator hub using a threaded pin of a corresponding ventilator blade that is to be fastened; and welding the at least one segment of the reinforcement element to each other to form a continuous and substantially annular reinforcement.

* * * * *